US008348376B2

(12) United States Patent
Munakata

(10) Patent No.: US 8,348,376 B2
(45) Date of Patent: Jan. 8, 2013

(54) LIQUID EJECTING APPARATUS

(75) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 189 days.

(21) Appl. No.: 13/006,301

(22) Filed: Jan. 13, 2011

(65) Prior Publication Data

US 2011/0211005 A1 Sep. 1, 2011

(30) Foreign Application Priority Data

Mar. 1, 2010 (JP) ..... 2010-043853

(51) Int. Cl.

| | |
|---|---|
| ***B41J 29/38*** | (2006.01) |
| ***B41J 2/15*** | (2006.01) |
| ***B41J 2/21*** | (2006.01) |
| ***B41J 2/145*** | (2006.01) |
| ***B41J 2/175*** | (2006.01) |

(52) U.S. Cl. ..... 347/14; 347/40; 347/43; 347/85

(58) Field of Classification Search ..... 347/14, 347/40, 43, 85

See application file for complete search history.

(56) References Cited

U.S. PATENT DOCUMENTS

2005/0035985 A1* 2/2005 Taguchi et al. ..... 347/7

FOREIGN PATENT DOCUMENTS

| | | |
|---|---|---|
| JP | 2000-015837 | 1/2000 |
| JP | 2003-001842 | 1/2003 |
| JP | 2005-035103 | 2/2005 |
| JP | 2005-088568 | 4/2005 |

* cited by examiner

*Primary Examiner* — Uyen Chau N Le
*Assistant Examiner* — Kajli Prince
(74) *Attorney, Agent, or Firm* — Workman Nydegger

(57) ABSTRACT

A printer includes first and second ejecting sections of which positions of nozzles are different from each other in a sub scanning direction, and an ejecting section group. The ejecting section group includes first and second individual ejecting sections of which the positions of the nozzles are same in the sub scanning direction. When a frequency of ejecting the liquid using the first and second ejecting sections and the first and second individual ejecting sections are Ra, Rb, Rc and Rd, the first mode in which Ra:Rb:Rc:Rd is 1:1:1:0, a second mode in which Ra:Rb:Rc:Rd is 1:1:0:1 and a third mode in which Ra:Rb:Rc:Rd is 1:1:0.5:0.5 are selected on the basis of the residual amounts of the ink.

7 Claims, 9 Drawing Sheets

FIG. 5

| | FIRST MODE | SECOND MODE | THIRD MODE |
|---|---|---|---|
| RATIO OF FREQUENCY OF USAGE Ra : Rb : Rc : Rd | 1 : 1 : 1 : 0 | 1 : 1 : 0 : 1 | 1 : 1 : 0.5 : 0.5 |
| INK CONSUMPTION AMOUNT OF INK CARTRIDGE 34 ( mg / SHEET ) | 12 | 7 | 9.5 |
| INK CONSUMPTION AMOUNT OF INK CARTRIDGE 35 ( mg / SHEET ) | 7 | 12 | 9.5 |

LIQUID EJECTING APPARATUS

The entire disclosure of Japanese Patent Application No: 2010-043853, filed Mar. 1, 2010 are expressly incorporated by reference herein.

BACKGROUND

1. Technical Field

The present invention relates to a liquid ejecting apparatus that ejects liquid from nozzles.

2. Related Art

In the related art, as the liquid ejecting apparatus that ejects liquid droplets onto a target, there is an ink jet type printer that prints an image or the like on a paper onto which ink droplets are ejected. In this kind of printer, a recording head is moved in a main scanning direction and the paper is moved in a sub scanning direction. The recording head and ink cartridges are loaded on a carriage and moved. A nozzle column is formed in a lower surface of the recording head, and the ink cartridge and the nozzle column communicate with each other through a flow channel. The ink flows in the flow channel from the ink cartridges to the nozzle columns.

In JP-A-2003-1842, a printer is disclosed wherein the printer includes first and second ink cartridges that contain the same color ink, a first flow channel communicates the first ink cartridge with a first nozzle column, and a second flow channel communicates the second ink cartridge to a second nozzle column. Also, the nozzles of the first nozzle column and the nozzles of the second nozzle column are arranged in positions spaced out in the sub scanning direction (a paper transporting direction). Thus, the ink is simultaneously ejected from the first and the second nozzle columns so that the print can be performed in dots of two rows simultaneously. Furthermore, the printer includes an ink residual amount detection section that detects ink residual amounts in the first and the second ink cartridges; and a selecting section that selects the ink cartridge used for a dot formation according the ink residual amount.

In a case where there is a difference in the ink residual amount between the first and the second ink cartridges, a control is performed such that ink is ejected from the nozzle column that corresponds to the ink cartridge having a large ink residual amount, while ink is not ejected from the nozzle column that corresponds to the ink cartridge having a small ink residual amount. Thus, the difference between the ink residual amounts can be decreased and exchange timings between the ink cartridges can be made equal to each other.

However, in the printer according to the related art, the ink is ejected from one side nozzle column and the ink is not ejected from the other side nozzle column of the first and the second nozzle columns so as to adjust the difference between the ink residual amounts. Thus, the dots of two rows are usually formed with one main scanning, but the dots of one row are formed with one main scanning when the ink residual amount is adjusted, so there is a problem that the printing speed is delayed. Also, in a case where the printing speed is maintained, there is a problem that resolution is lowered.

SUMMARY

An advantage of some aspects of the invention is that the printing speed or the resolution is maintained and the difference between the residual amounts in the ink cartridges is decreased so that the plurality of ink cartridges is capable of being exchanged in the same period.

According to an aspect of the invention, there is provided a liquid ejecting apparatus that receives liquid from a first and a second liquid storing material that store the same liquid and eject the liquid including: first and second ejecting sections in which a plurality of nozzles are formed parallel to a first direction and the positions of the nozzles are different from each other in the first direction, an ejecting section group that includes first and second individual ejecting sections in which the positions of the nozzles are different to the first and the second ejecting section in the first direction and the positions of the nozzles thereof are the same in the first direction, a first flow channel that is branched from the first liquid storing material and communicates with the first ejecting section and the first individual ejecting section, a second flow channel that is branched from the second liquid storing material and communicates with the second ejecting section and the second individual ejecting section, a liquid residual amount detection section that detects first and second residual amounts that are the residual amounts of the liquid that is contained in each of the first and the second liquid storing materials, and a control section that is capable of selecting a first mode that controls so as to be Ra:Rb:Rc:Rd=1:1:1:0, a second mode that controls so as to be Ra:Rb:Rc:Rd=1:1:0:1 and a third mode that controls so as to be Ra:Rb:Rc:Rd=1:1:0.5:0.5, when frequency of ejecting the liquid using the first and the second ejecting sections and the first and the second individual ejecting sections are Ra, Rb, Rc and Rd, wherein the control section selects any one of the first mode, the second mode and third mode on the basis of the first and the second residual amounts so that exchange timings of the first and the second liquid storing materials are equal to each other.

According to the invention, the first to the third modes are selected according to the first and the second residual amounts, so that even if the difference is present in the residual amounts, the difference between the residual amounts may be decreased and thus exchange timings of the first and the second liquid storing materials may be equal to each other. In other words, any one of the first mode, the second mode and the third mode is selected on the basis of the first and the second residual amounts so that the liquid which is contained in the first and the second liquid storing materials is removed in the same period.

As a result, two liquid storing materials can be exchanged in the same timing and the effort of the user can be lessened. Also, when the liquid storing materials are exchanged, there is a need to perform a cleaning process that absorbs a constant amount of the liquid and to perform a brushing process that ejects a constant amount of the liquid, but the liquid amount that is ejected in the cleaning process and the brushing process can be decreased by in reduction in the number of exchanges.

Furthermore, the nozzles of the first ejecting section, the second ejecting section and the first and the second individual ejecting sections are arranged differently in the first direction. Thus, in the first mode, the liquid droplets are ejected from the first ejecting section, the second ejecting section, and the first individual ejecting section; in the second mode, the liquid droplets are ejected from the first ejecting section, the second ejecting section, and the second individual ejecting section; and in the third mode, the liquid droplets are ejected from the first ejecting section, the second ejecting section, and the first and the second individual ejecting sections. In other words, in all modes, the ink droplets are ejected from the three types of nozzle positions. Accordingly, the printing speed or the resolution is not deteriorated compared to the third mode M3, even in the period in which the first mode or the second mode is selected and the residual amount of the liquid is adjusted.

It is preferable that the control section calculates a difference between the first and the second residual amounts, selects the third mode in a case where the difference is within a predetermined range, selects the first mode in a case where the difference is outside the predetermined range and the first residual amount is larger than the second residual amount, and selects the second mode in a case where the difference is outside the predetermined range and the first residual amount is smaller than the second residual amount.

According to the selection of the mode as described above, the third mode is selected and the liquid of the first and the second liquid storing materials is evenly consumed in a case where the difference between the first and the second residual amounts is within a predetermined range, the liquid of the first liquid storing material is consumed more than that of the second liquid storing material in a case where the first residual amount is larger than the second residual amount, and the liquid of the second liquid storing material is consumed more than that of the first liquid storing material in a case where the second residual amount is larger than the first residual amount. Accordingly, exchange timings of the first liquid storing material and the second liquid storing material can be equal to each other.

It is preferable that the control section changes the first and the second individual ejecting sections to each other per unit period and uses them in order in the third mode.

It is preferable that the liquid is ink, the first and the second ejecting sections and the first and the second individual ejecting sections eject the ink on a paper, the unit period is a period that prints a predetermined number of papers, and the control section changes the first individual ejecting section and the second individual ejecting section to each other per the predetermined number and uses them in order in the third mode.

It is preferable that the unit period is a period that prints a predetermined column number of papers, and the control section changes the first individual ejecting section and the second individual ejecting section to each other per the predetermined column number and uses them in order in the third mode.

It is preferable that the unit period is a period that prints a predetermined row number of papers, and the control section changes the first individual ejecting section and the second individual ejecting section to each other per the predetermined row number and uses them in order in the third mode.

As described above, the individual ejecting sections can be changed in sequence so that the control for adjusting the frequency of usage can be brief.

According to another aspect of the invention, there is provided a liquid ejecting apparatus that receives liquid from first and second liquid storing materials that store the same liquid and eject the liquid including: first and second ejecting sections in which a plurality of nozzles are formed parallel to a first direction and the positions of the nozzles are different to each other in the first direction, an ejecting section group that includes first and second individual ejecting sections in which the positions of the nozzles are different to the first and the second ejecting sections in the first direction and the position of the nozzles is the same in the first direction, a first flow channel that is branched from the first liquid storing material and communicates with the first ejecting section and the first individual ejecting section, a second flow channel that is branched from the second liquid storing material and communicates with the second ejecting section and the second individual ejecting section, a liquid residual amount detection section that detects first and second residual amounts that are the residual amounts of the liquid that is contained in each of the first and the second liquid storing materials, and a control section that is capable of selecting a first mode that controls so as to be Ra:Rb:Rc:Rd=1:1:1:0, and a second mode that controls so as to be Ra:Rb:Rc:Rd=1:1:0:1, when the frequency of ejecting the liquid using the first and the second ejecting sections and the first and the second individual ejecting sections is Ra, Rb, Rc and Rd, wherein the control section compares the first and the second residual amounts, selects the first mode in a case where the first residual amount is larger than the second residual amount, and selects the second mode in a case where the first residual amount is smaller than the second residual amount.

According to the invention, there is no need to determine whether the difference between the first and the second residual amounts is within the predetermined range. Furthermore, the mode selection is either the first mode or the second mode so that the process can be brief. The first and the second residual amounts are compared always and one mode is selected so that the control is performed so as to equal the first and the second residual amounts. Thus, exchange timings of the first liquid storing material and the second liquid storing material can be equal to each other and the effort of the user can be lessened. The number of exchanges is decreased so that the liquid amount that is consumed in the cleaning process and the brushing process can be decreased.

BRIEF DESCRIPTION OF THE DRAWINGS

The invention will be described with reference to the accompanying drawings, wherein like numbers reference like elements.

FIG. 5 is a table showing a relation between a frequency of usage and an ink consumption amount in each of the modes.

DESCRIPTION OF EXEMPLARY EMBODIMENTS

First Embodiment

Figure 1:
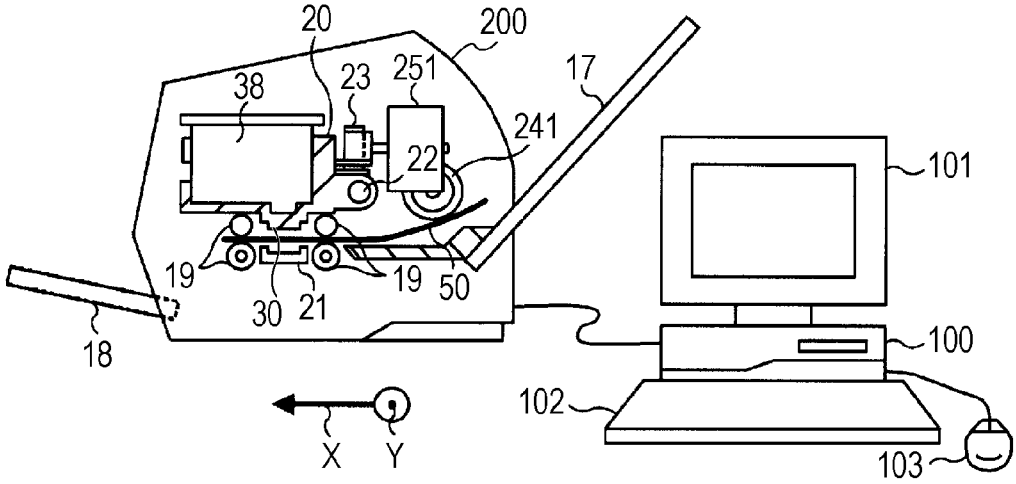
FIG. 1 is a block view showing overall configuration of a printing system according to a first embodiment of the invention.

As shown in FIG. 1, a printing system as a liquid ejecting system of the first embodiment consists of a computer 100 which a user can use and an ink jet type color printer (hereinafter, referred to as printer) 200 as a liquid ejecting apparatus that is connected to the computer 100. The computer 100 includes a keyboard 102 and a mouse 103; and a letter input or setting change is performed according to the operation of the keyboard 102 and the mouse 103. Also, the computer 100 is connected to a monitor 101. The user uses the monitor 101 and instructs a designation of a document image to be printed or a printing performance.

Meanwhile, the printer 200 includes a paper feeding tray 17 and a paper discharging tray 18 that are disposed outside of the main body; and a plurality of paper transport rollers 19 that is disposed inside of the main body. The paper transport rollers 19 are properly driven by a paper transport motor 241. Thus, the printer 200 introduces a media 50 that is a target from the paper feeding tray 17 and after the media 50 is transported toward a sub scanning direction X, the media 50 is discharged to the paper discharging tray 18. A typical example of the media 50 is an ordinary paper, however the media 50 may be anything if it is a printing object, such as, for example, a glossy exclusive paper, a non-glossy exclusive paper, a cloth material, a mat paper, a vinyl chloride or the like.

The printer 200 includes a carriage 20 and a platen 21 that faces the carriage 20 internally. The platen 21 is a supporting base that supports the media 50 when the printing is performed and the media 50 is transported over the platen 21 by the paper transport rollers 19 when the printing is performed. The carriage 20 is fitted to a guide shaft 22 and fixed in a timing belt 23. A carriage motor 251 drives the timing belt 23. Thus, the carriage 20 is capable of reciprocating in a main scanning direction Y (a direction orthogonal to a paper surface of FIG. 1).

Figure 2:
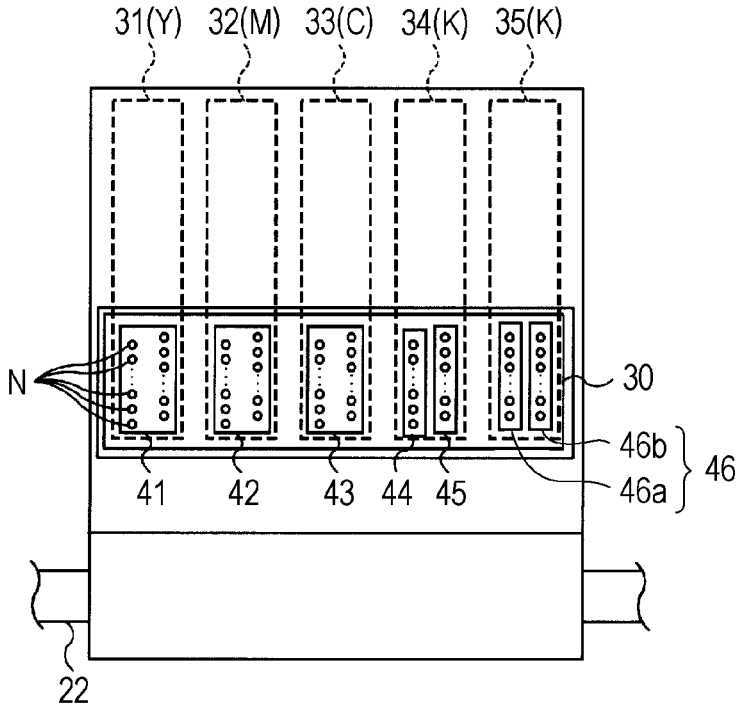
FIG. 2 is a lower plan view showing a recording head.

As shown in FIG. 1, the carriage 20 has a recording head 30 as a liquid ejecting head beneath it. As shown in FIG. 2, ejecting sections 41, 42, 43, 44 and 45 on which a nozzle column having a plurality of nozzles N is formed; and an ejecting section group 46 is disposed in the surface beneath the recording head 30. The recording head 30 ejects the ink onto the media 50 from the nozzle column according to the extension and contraction of a piezoelectric element 261 shown in FIG. 4. Accordingly, the carriage 20 moves in the main scanning direction Y and simultaneously ejects ink of each color from the recording head 30 so that printing is performed on the media 50.

As shown in FIG. 2, the same shaped five ink cartridges 31, 32, 33, 34 and 35 are loaded on the carriage 20. Each of the ink cartridges 31 to 35 is connected to each of two columns of nozzles N that are positioned respectively beneath them. Thus, the ink in each of the ink cartridges 31 to 35 is ejected outside from the nozzle columns that are formed at the ejecting sections 41 to 45 and an ejecting section group 46 that is positioned beneath them.

A yellow Y ink is contained in the ink cartridge 31, a magenta M ink is contained in the ink cartridge 32, a cyan C ink is contained in the ink cartridge 33, and a black K ink is contained in the ink cartridges 34 and 35 respectively. In other words, one for each of cyan, magenta and yellow ink cartridges, and two black ink cartridges are loaded onto the carriage 20. When the ink is not used, the same amount of ink is contained in the black ink cartridges 34 and 35 respectively. In the description hereinafter, the ink cartridge 34 is referred to as a first ink cartridge 34, the ink cartridge 35 is referred to as a second ink cartridge 35.

Figure 3:
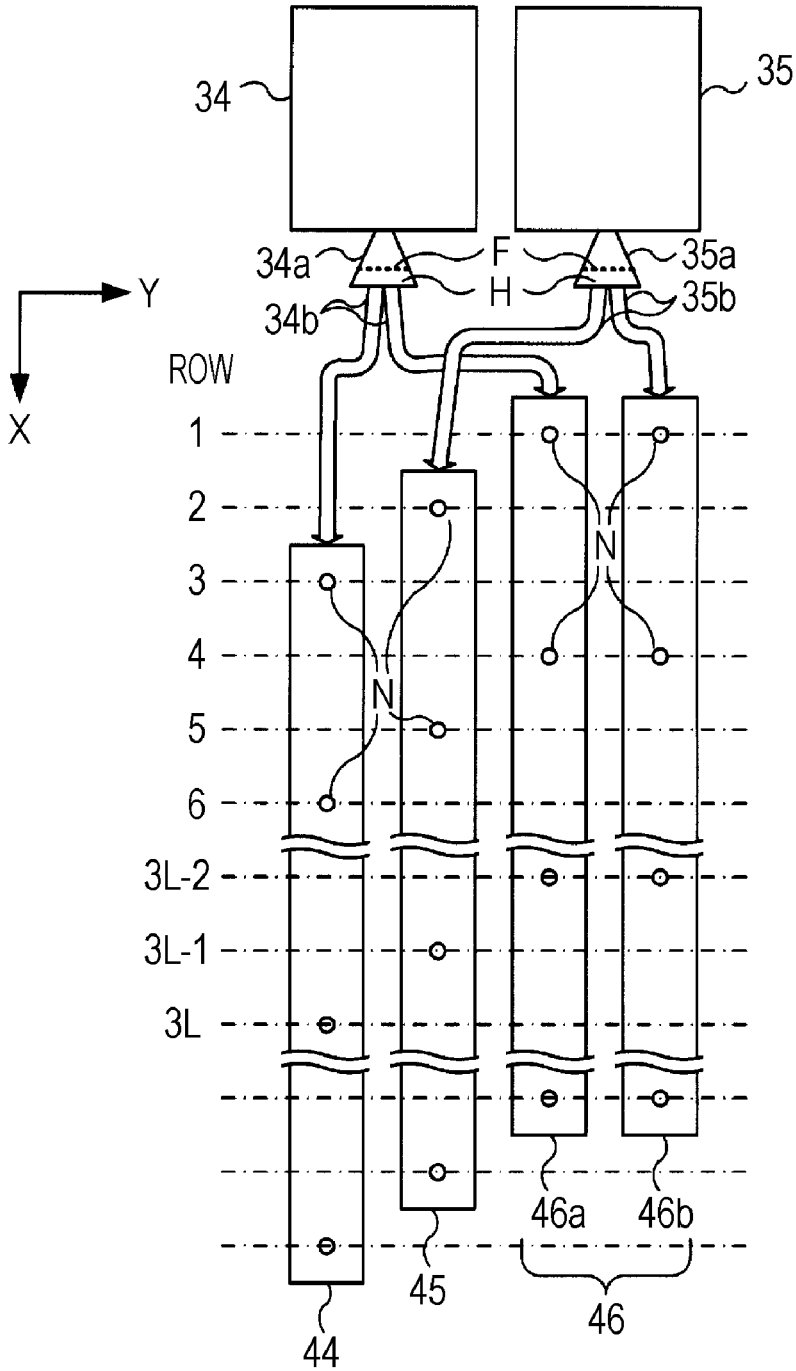
FIG. 3 is an illustrative view showing a relation between a black ink cartridge, an ejecting section and an individual ejecting section.

FIG. 3 is an illustrative view showing a relation between the first and the second ink cartridges 34 and 35 of the black K, an ejecting section, and an individual ejecting section. A film covers some of the bottom surface of the first and the second ink cartridges 34 and 35. Meanwhile, a needle 34*a* and a needle 35*a* are disposed in the carriage 20 so that when the first and the second ink cartridges 34 and 35 are disposed in the carriage 20, the needles 34*a* and 35*a* break through the film and are stuck within the first and the second ink cartridges 34 and 35. The tips of the needle 34*a* and the needle 35*a* have open holes so that the ink flows out through the holes. In other ink cartridges 31 to 35, the ink also flows out through the same configuration. Thus, the base portions of the needle 34*a* and 35*a* are segmented with films F that prevent them from inputting mixed foreign matter, air bubbles or the like. First and second flow channels 34*b* and 35*b* that are branched are disposed in ink chambers H. Hereinafter, the ejecting sections 44 and 45 are referred to as the first and the second ejecting sections 44 and 45, and the individual ejecting sections 46*a* and 46*b* are referred to as the first and the second individual ejecting sections 46*a* and 46*b*.

A plurality of nozzles N is formed in the first and the second ejecting sections 44 and 45 and the ejecting section group 46. In the nozzle column of the first ejecting section 44, the nozzle N is positioned at a row 3L, in the nozzle column of the second ejecting section 45, the nozzle N is positioned at a row 3L-1 and in the nozzle column of the ejecting section group 46, the nozzle N is positioned at a row 3L-2. Here, L is a natural number. As described above, the nozzles N of the first and the second ejecting sections 44 and 45 and the ejecting section group 46 are arranged in different positions in the sub scanning direction X. The ejecting section group 46 includes the first and the second individual ejecting sections 46*a* and 46*b* on which the nozzles N are arranged in the same position in the sub scanning direction X.

Thus, the first flow channel 34*b* communicates with the first ink cartridge 34, the first ejecting section 44 and the first individual ejecting section 46*a*; and the second flow channel 35*b* communicates with the second ink cartridge 35, the second ejecting section 45 and the second individual ejecting section 46*b*.

In other words, in the embodiment, two of the first and the second ink cartridges 34 and 35, three kinds of the first and the second ejecting sections 44 and 45, and the ejecting section group 46 in which the positions of the nozzles N are different to each other in the sub scanning direction X are communicated through the first and the second flow channels 34*b* and 35*b*.

Also, pressure chambers are disposed in the first and the second ejecting sections 44 and 45, and the first and the second individual ejecting sections 46*a* and 46*b*, respectively corresponding to the plurality of nozzles N. A piezoelectric element 261 (see FIG. 4) is arranged within. Pressure in the pressure chamber is changed by extension and contraction of the piezoelectric element 261, and the ink droplets are ejected from nozzles N onto the media 50.

Figure 4:
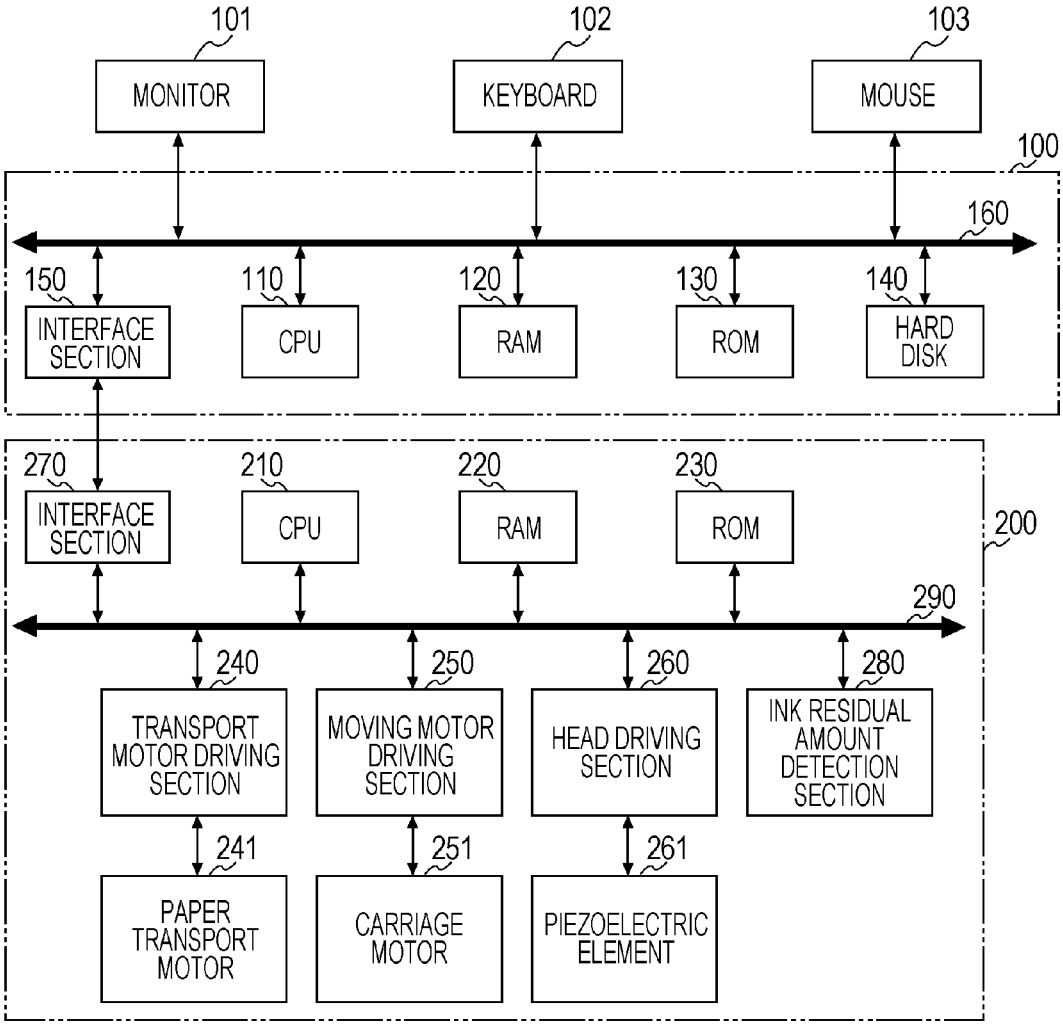
FIG. 4 is a block diagram showing an electric configuration of the printing system.

Next, a description will be made regarding an electronic configuration of the printing system with reference to FIG. 4. The computer 100 is connected to the keyboard 102, the mouse 103 and the monitor 101 through a bus line 160, and includes a CPU 110 that functions as a control hub.

Also, the CPU 110 is connected to a RAM 120 and a ROM 130. The RAM 120 functions as a working area of the CPU 110 and a boot program or the like is stored in the ROM 130. The CPU 110 is capable of access to the hard disk 140 through the bus line 160. Data and the program are stored in the hard disk 140. As the data, document data that are a printing object, drawing data, image data or the like are applicable. As the program, a program for a printer driver that is read and installed from an information recording medium (not shown) and an application program for printing are assembled therein.

The program for the printer driver is a program that converts the printing data to middle image data that are capable of being processed in the printer 200, wherein the printing data is liquid ejecting data that are prepared on the basis of the document data, the image data or the like. For example, there are signals that are multi valued in respect of each color of cyan, magenta, yellow and black. The application program for printing is a program that performs a predetermined operation in the CPU 110 to perform acquisition, calculation or the like of the information that is needed for the printing according to the operation of the user. In other words, the CPU 110 performs generation of the printing data or the like so as to eject predetermined color ink onto the media 50 from each of the nozzles N according to the application program for printing.

Furthermore, the CPU 110 communicates with the printer 200 through an interface section 150.

Meanwhile, the printer 200 includes a CPU 210 that functions as the control hub and the CPU 210 communicates with the computer 100 through an interface section 270. The CPU 210 is connected to a RAM 220 and a ROM 230 through a bus line 290. The RAM 220 functions as a working area and temporarily stores the printing data that is received from the computer 100. A predetermined program is stored in the ROM 230 and the CPU 210 performs a predetermined operation and the printing is performed on the basis of the program.

The CPU 210 of the printer 200 is connected to each of driving sections such as a transport motor driving section 240, a moving motor driving section 250 and a head driving section 260. The transport motor driving section 240 drives a paper transport motor 241, the moving motor driving section 250 drives a carriage motor 251 and the head driving section 260 drives the piezoelectric element 261 respectively under the control of the CPU 210. The CPU 210 is connected to an ink residual amount detection section 280. The ink residual amount detection section 280 detects the ink residual amount of each of the ink cartridges 31 to 35 and outputs them.

The head driving section 260 drives the piezoelectric element 261 synchronized with the driving of the carriage motor 251 and the paper transport motor 241. In white and black printing and color printing, the black ink is ejected from the first and the second ejecting sections 44 and 45, and the ejecting section group 46 (the first and the second individual ejecting sections 46*a* and 46*b*), that communicate with the first and the second ink cartridges 34 and 35.

When the first and the second ink cartridges 34 and 35 are exchanged, so-called cleaning process and brushing process are performed. In the cleaning process, the carriage 20 is moved to an area that is away from the media 50, a cap member is contacted with the nozzle surface of the recording head and a suction operation is performed. In the brushing process, the carriage 20 is moved to an area that is away from the media 50 and the ink is ejected. Thus, the ink can be evenly reached at the first and the second flow channels 34*b* and 35*b*. The ink that is consumed in the cleaning process and the brushing process is not contributed to the printing so that the ink cartridges 34 and 35 are preferably changed simultaneously to increase the usage efficiency of the ink.

Thus, in a case where the ink residual amounts in the first and the second ink cartridges 34 and 35 are the same as each other, the ink is needed to decrease at the same speed. Also, in a case where the ink residual amounts are unequal, the ink consumption of the ink cartridge that has a large ink residual amount is needed to increase more than that of the ink cartridge that has a small ink residual amount.

The head driving section 260 changes the frequency of usage of the first and the second ejecting sections 44 and 45; and the first and the second individual ejecting sections 46*a* and 46*b* according to the residual amounts of the first and the second ink cartridges 34 and 35 under the control of the CPU 210.

Embodiments of the frequency of usage are a first mode M1, a second mode M2 and a third mode M3 shown in FIG. 5. When the frequency of usage of the first and the second ejecting sections 44 and 45; and the first and the second individual ejecting sections 46*a* and 46*b* are Ra, Rb, Rc and Rd. In the first mode M1, Ra:Rb:Rc:Rd is 1:1:1:0. In the second mode M2, Ra:Rb:Rc:Rd is 1:1:0:1. Furthermore, in the third mode M3, Ra:Rb:Rc:Rd is 1:1:0.5:0.5. In the first mode M1, the first ink cartridge 34 consumes 12 mg of ink in printing one sheet and the second ink cartridge 35 consumes 7 mg of ink in printing one sheet. In the second mode M2, the first ink cartridge 34 consumes 7 mg of ink in printing one sheet and the second ink cartridge 35 consumes 12 mg of ink in printing one sheet. Furthermore, in the third mode M3, the first and the second ink cartridges 34 and 35 consume 9.5 mg ink in printing one sheet.

Figure 6:
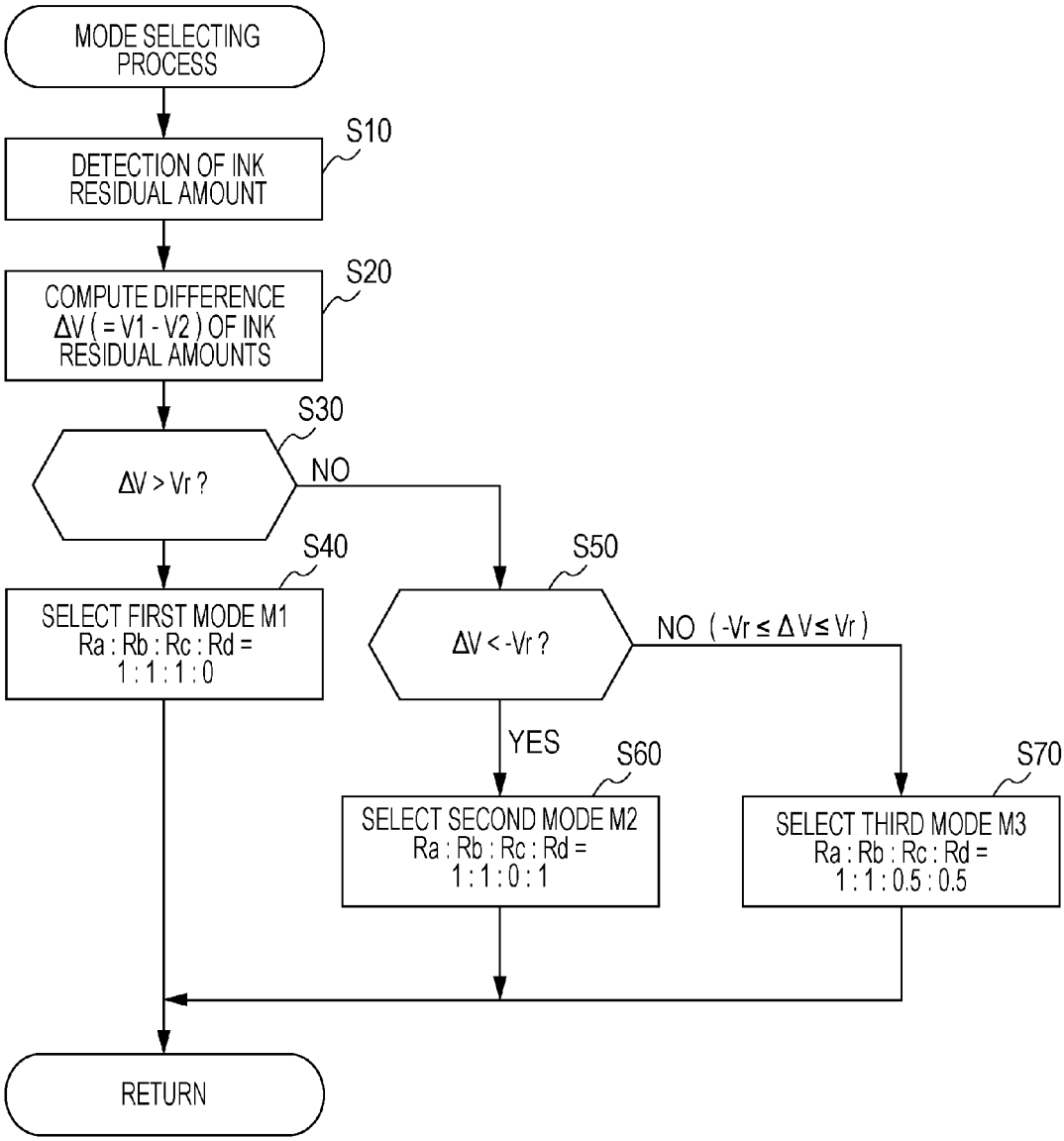
FIG. 6 is a flow chart showing a process content of a mode selecting process.

Next, a description will be given regarding the mode selecting process that is performed by the CPU 210. FIG. 6 is a flow chart showing a process content of a mode selecting process. First of all, the CPU 210 detects an ink residual amount V1 of the first ink cartridge 34 and an ink residual amount V2 of the second ink cartridge 35 using the ink residual amount detection section 280 (step S10).

Next, the CPU 210 computes a difference ΔV of the ink residual amounts (step S20). The difference ΔV is obtained from a formula ΔV=V1−V2.

The CPU 210 determines whether the difference ΔV is over a threshold value Vr (step S30). In a case where the difference ΔV is over the threshold value Vr, the ink residual amount V1 is larger than the ink residual amount V2 over the threshold value Vr. In this case, the CPU 210 selects the first mode M1 (step S40) and drives the piezoelectric element 261 so that the frequency of usage is Ra:Rb:Rc:Rd=1:1:1:0. In other words, in the first mode M1, the first individual ejecting section 46*a* is used in priority to the second individual ejecting section 46*b*, wherein the first individual ejecting section 46*a* communicates with the first ink cartridge 34 in which a large ink amount is contained and the second individual ejecting section 46*b* communicates with the second ink cartridge 35 in which a small ink amount is contained. Thus, the ink residual amount V1 of the first ink cartridge 35 can be moved closer to the ink residual amount V2.

In a case where the difference ΔV is not over the threshold value Vr, the CPU 210 is advanced to step S50 and determines whether the difference ΔV is below the threshold value −Vr (step S50). In a case where the difference ΔV is below the threshold value −Vr, the ink residual amount V2 is larger than the ink residual amount V1 over the threshold value Vr. In this case, the CPU 210 selects the second mode M2 (step S60) and drives the piezoelectric element 261 so that the frequency of usage is Ra:Rb:Rc:Rd=1:1:0:1. In other words, in the second mode M2, the second individual ejecting section 46*b* is used in priority to the first individual ejecting section 46*a*, wherein the second individual ejecting section 46*b* communicates with the second ink cartridge 35 in which a large ink amount is contained and the first individual ejecting section 46*a* communicates with the first ink cartridge 34 in which a small ink amount is contained. Thus, the ink residual amount V2 of the second ink cartridge 35 can be moved closer to the ink residual amount V1.

Next, in a case where the determination condition of step S50 is NO, in other words, in a case where the difference ΔV is within a predetermined range from the threshold value −Vr to the threshold value Vr, −Vr≦ΔV≦Vr, the CPU 210 selects the third mode M3 (step S70) and drives the piezoelectric element 261 so that the frequency of usage is Ra:Rb:Rc:Rd=1:1:0.5:0.5.

In this case, the ink in the first ink cartridge 34 and the ink in the second ink cartridge 35 are consumed in uniformity.

Figure 7:
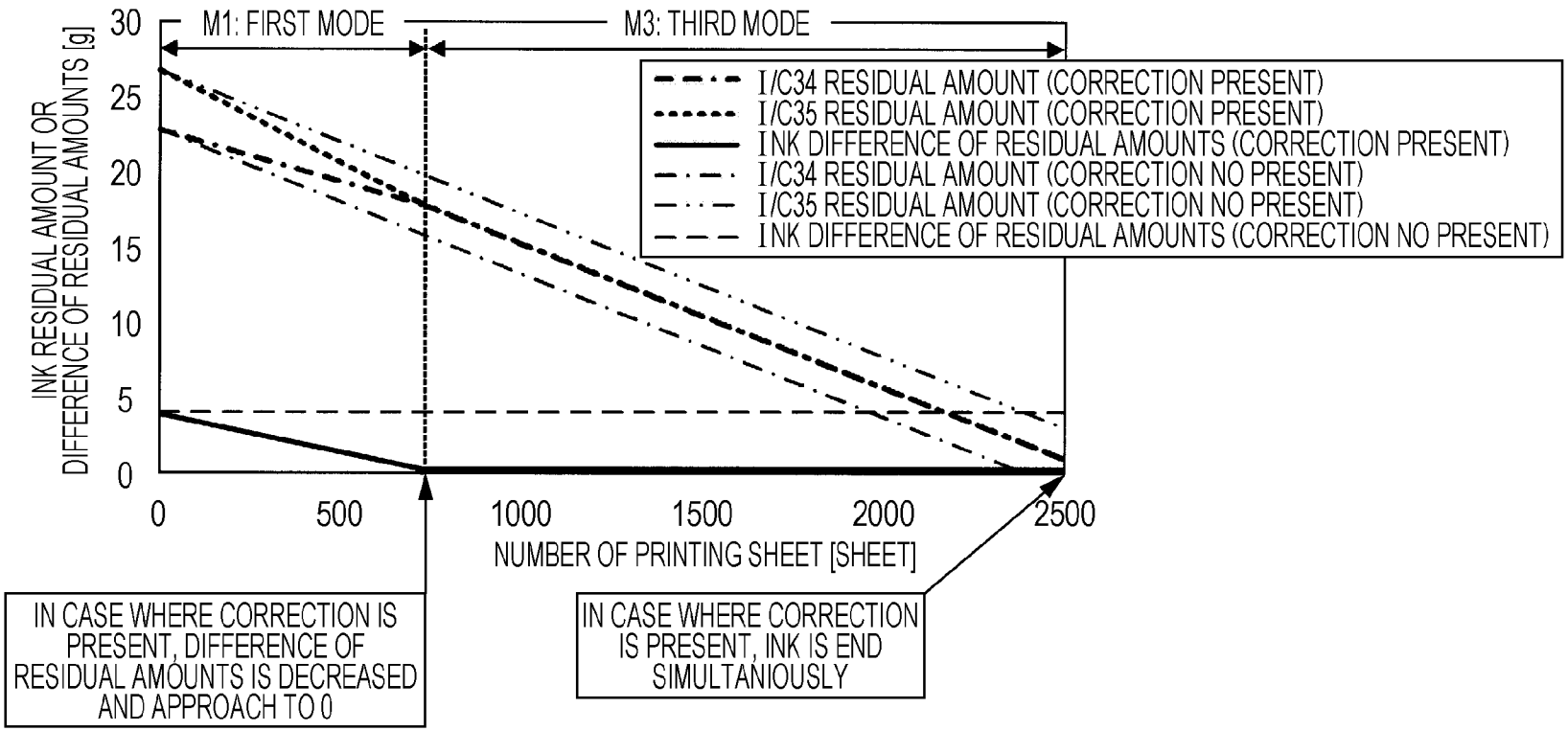
FIG. 7 is a graph showing a concrete example of a relation between an ink residual amount and a selected mode.

For example, there is assumed a case in which 27.5 g of ink is contained in the first ink cartridge 34 and 22.5 g of ink is contained in the second ink cartridge 35 as initial values. FIG. 7 shows a relation between the ink residual amount and selection of the mode. The threshold value Vr is 0.2 mg. The ink residual amount V1 is 27.5 g as the initial value and is larger than the ink residual amount V2 (=22.5 g), so that the first mode M1 is selected. Thus, the ink consumption amount in the first ink cartridge 34 can be larger than the ink consumption amount in the second ink cartridge 35 so that the ink residual amounts in both sides can be close to each other. At a time of printing about 750 sheets, the ink residual amount V1 and the ink residual amount V2 are nearly close to each other and the third mode M3 is performed.

In the third mode M3, the ink consumption amount is the same for the two ink cartridges so that the exchange timing of the first and the second ink cartridges 34 and 35 can match each other. In the ejecting section group 46, the nozzle N positions of the first and the second individual ejecting sections 46*a* and 46*b* are the same in the sub scanning direction X and the nozzle N is positioned in a row 3L-2 shown in FIG. 3.

As described above, in each of the first to the third modes M1 to M3, the dots are formed in three rows simultaneously. Accordingly, even the first mode M1 or the second mode M2 is selected, the printing speed is not lowered and the printing quality is not deteriorated compared to the third mode M3.

In the third mode M3, the piezoelectric element 261 is driven such that the frequency of usage is Ra:Rb:Rc:Rd=1:1:0.5:0.5.

Figure 8:
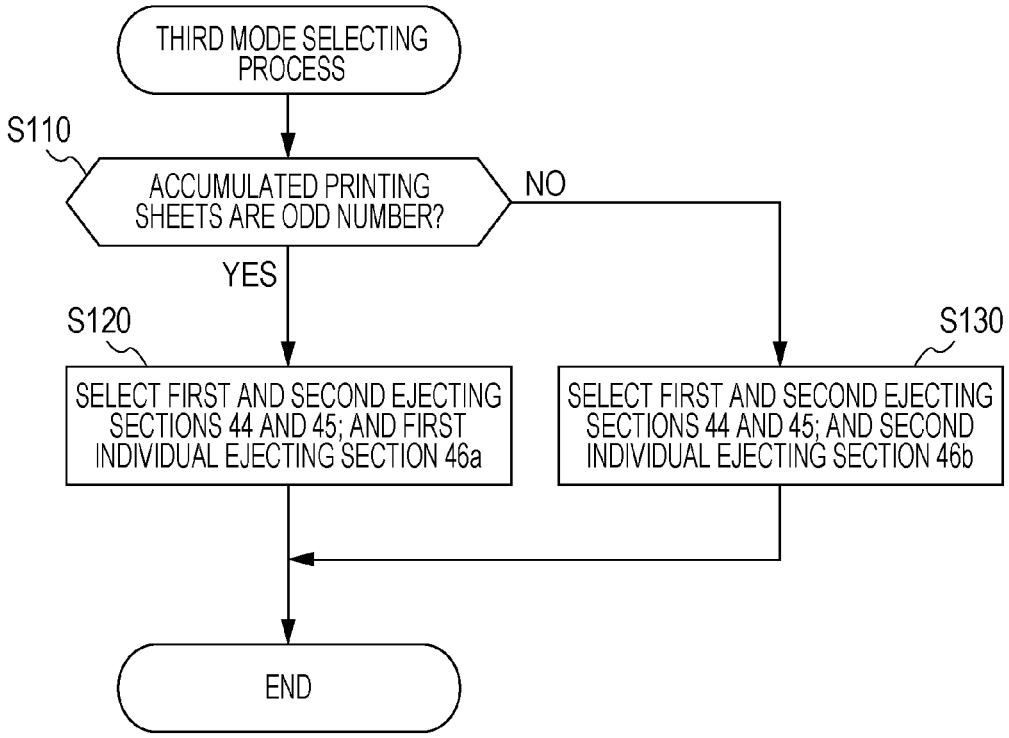
FIG. 8 is a flow chart showing a first embodiment of a third mode selecting process.

More specifically, three embodiments regarding the selection of the ejecting sections that are used are present as described below. FIG. 8 is a flow chart showing a first embodiment of a third mode selecting process that is performed by the CPU 210. First of all, the CPU 210 determines whether the number of printing sheets that are accumulated from power-on is an odd number or not (step S110).

In a case where the number of the printing sheets is an odd number, it advances to step S120. The CPU 210 selects the first and the second ejecting sections 44 and 45; and the first individual ejecting section 46*a*, and thus drives the piezoelectric element 261 corresponding to these nozzle columns. In this case, the first ink cartridge 34 communicates with the first ejecting section 44 and the first individual ejecting section 46*a* through the first flow channel 34*b* so that when an average value of the ink amount that is needed to print a sheet in one ejecting section is Q, in a case where the number of the printing sheets is an odd number, the ink amount of the first ink cartridge 34 is decreased only by "2Q". Meanwhile, in a case where the number of the printing sheets is an odd number, the ink amount of the second ink cartridge 35 is decreased only by "Q". In the case where the number of the printing sheets is odd number, a ratio of the frequency of usage of the first and the second ejecting sections 44 and 45; and the first and the second individual ejecting sections 46*a* and 46*b* is 1:1:1:0.

Next, in a case where the number of the printing sheets is an even number, it advances to step S130. The CPU 210 selects the first and the second ejecting sections 44 and 45, and the second individual ejecting section 46*b*, and thus drives the piezoelectric element 261 corresponding to these nozzle columns. In this case, the second ink cartridge 35 communicates with the second ejecting section 45 and the second individual ejecting section 46*b* through the second flow channel 35*b* so that in a case where the number of the printing sheets is an even number, the ink amount of the second ink cartridge 35 is decreased only by "2Q". The ink amount of the first ink cartridge 34 is decreased only by "Q". Also, in a case where the number of the printing sheets is an even number, a ratio of the frequency of usage is 1:1:0:1.

When these values are averaged, the ink amount of the first ink cartridge 34 is decreased by "1.5Q" and the ink amount of the second ink cartridge 35 is decreased by "1.5Q" per one sheet printing. Accordingly, the ink of the first and the second ink cartridges 34 and 35 are consumed evenly; and the exchange timings simultaneously match each other. An average of a ratio of the frequency of usage between the odd number and the even number is 1:1:0.5:0.5. In the embodiment, the first individual ejecting section 46*a* and the second individual ejecting section 46*b* are changed per one sheet, but individual ejecting sections that are used may also be changed per the predetermined sheet numbers.

Figure 9:
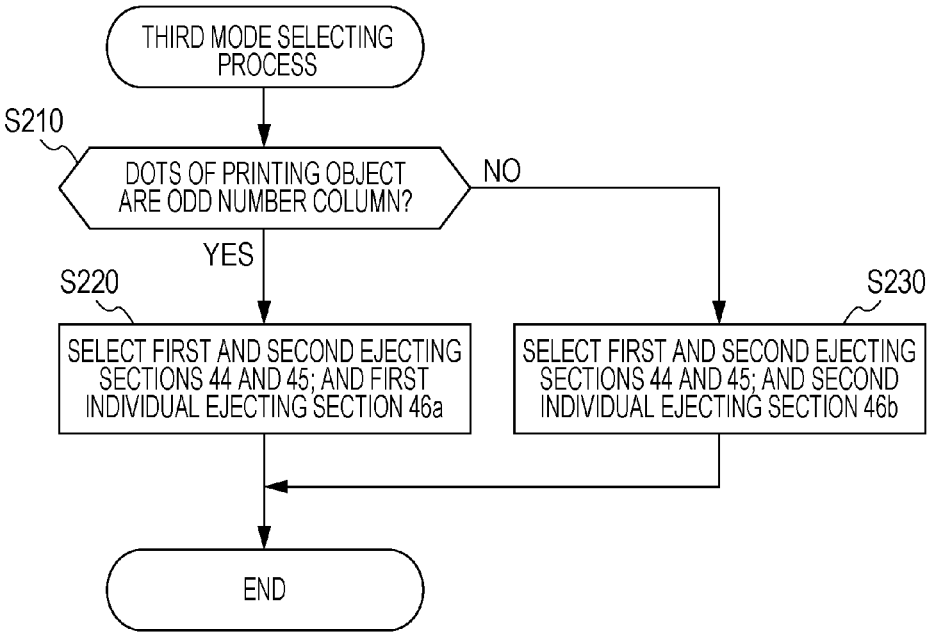
FIG. 9 is a flow chart showing a second embodiment of the third mode selecting process.

FIG. 9 is a flow chart showing a second embodiment of the third mode selecting process that is performed by the CPU 210. First of all, the CPU 210 determines whether a dot that is a printing object is an odd number column or not (step S210).

In a case where the dot of the printing object is an odd number column, it advances to step S220. The CPU 210 selects the first and the second ejecting sections 44 and 45; and the first individual ejecting section 46*a*, and thus drives the piezoelectric element 261 corresponding to these nozzle columns. In a case where the dot of the printing object is an odd number column, the ratio of the frequency of usage of the first and the second ejecting sections 44 and 45, and the first and the second individual ejecting sections 46*a* and 46*b* is 1:1:1:0.

Meanwhile, in a case where the dot of the printing object is an even number column, it advances to step S230. The CPU 210 selects the first and the second ejecting sections 44 and 45; and the second individual ejecting section 46*b*, and thus drives the piezoelectric element 261 corresponding to these nozzle columns. In a case where the dot of the printing object is an even number column, the ratio of the frequency of usage of the first and the second ejecting sections 44 and 45, and the first and the second individual ejecting sections 46*a* and 46*b* is 1:1:0:1.

The average of the ratio of frequency of usage of the odd number column and the even number column is that R1:R2:R3:R4=1:1:0.5:0.5. The first ink cartridge 34 communicates with the first ejecting section 44 and the first individual ejecting section 46*a* through the first flow channel 34*b* so that the ink amount that is consumed per unit time is proportional to "1.5" which is the sum of the frequency of usage of the first ejecting section 44 and the second individual ejecting section 46*b*. Meanwhile, the second ink cartridge 35 communicates with the second ejecting section 45 and the second individual ejecting section 46*b* through the second flow channel 35*b* so that the ink amount that is consumed per unit time is proportional to "1.5" which is the sum of the frequency of usage of the second ejecting section 45 and the second individual ejecting section 46*b*.

Accordingly, the ink of the first and the second ink cartridges 34 and 35 are consumed evenly and the exchange timings simultaneously match each other. Also, in the embodiment, the first individual ejecting section 46*a* and the second individual ejecting section 46*b* are changed per one column, but the individual ejecting sections that are used may also be changed per the predetermined column numbers.

Figure 10:
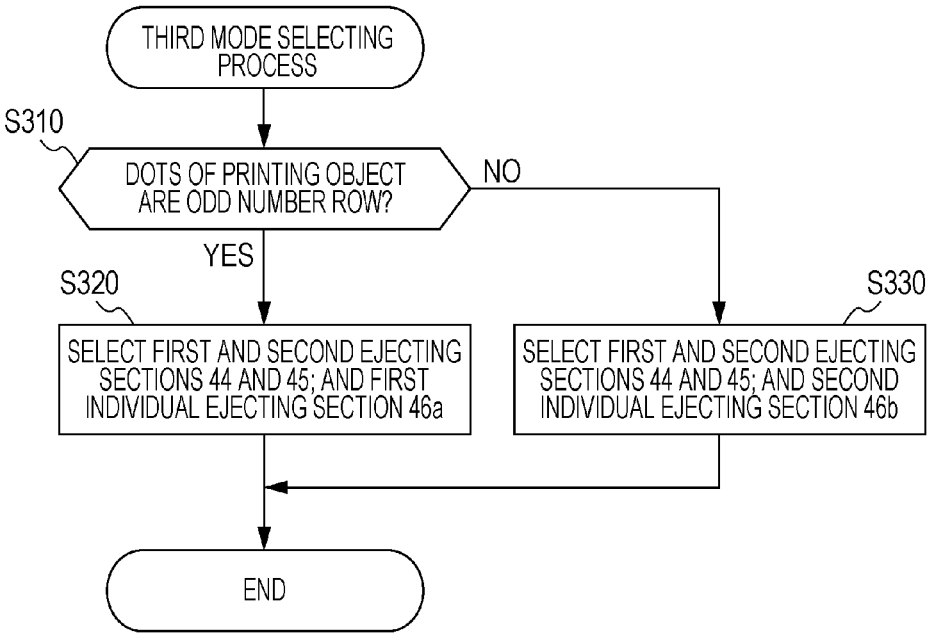
FIG. 10 is a flow chart showing a third embodiment of the third mode selecting process.

FIG. 10 is a flow chart showing a third embodiment of the third mode selecting process that is performed by the CPU 210. First of all, the CPU 210 determines whether the dot that is the printing object is an odd number row or not (step S310).

In a case where the dot of the printing object is an odd number row, it advances to step S320. The CPU 210 selects the first and the second ejecting sections 44 and 45, and the first individual ejecting section 46*a*, and thus drives the piezoelectric element 261 corresponding to these nozzle columns. In a case where the dot of the printing object is an odd number row, the ratio of the frequency of usage of the first and the second ejecting sections 44 and 45, and the first and the second individual ejecting sections 46*a* and 46*b* is 1:1:1:0.

Meanwhile, in a case where the dot of the printing object is an even number row, it advances to step S330. The CPU 210 selects the first and the second ejecting sections 44 and 45, and the second individual ejecting section 46*b*, and thus drives the piezoelectric element 261 corresponding to these nozzle columns. In a case where the dot of the printing object is an even number row, the average of the ratio of the frequency of usage of the first and the second ejecting sections 44 and 45, and the first and the second individual ejecting sections 46*a* and 46*b* is 1:1:0.5:0.5. Here, the first ink cartridge 34 communicates with the first ejecting section 44 and the first individual ejecting section 46*a* through the first flow channel 34*b* so that the ink amount that is consumed per unit time is proportional to "1.5" which is the sum of the frequency of usage of the first ejecting section 44 and the first individual ejecting section 46*a*. Meanwhile, the second ink cartridge 35 communicates with the second ejecting section 45 and the second individual ejecting section 46*b* through the second flow channel 35*b* so that the ink amount that is consumed per unit time is proportional to "1.5" which is the sum of the frequency of usage of the second ejecting section 45 and the second individual ejecting section 46*b*.

Accordingly, the ink of the ink cartridges 34 and 35 is consumed evenly and the exchange timings simultaneously match each other. Also, in the embodiment, the first individual ejecting section 46*a* and the second individual ejecting section 46*b* are changed per one row, but individual ejecting sections that are used may also be changed per the predetermined row numbers.

As described above, the first individual ejecting section 46*a* and the second individual ejecting section 46*b* may be changed per unit period such as the predetermined sheet numbers, the predetermined column numbers or the predetermined row numbers and then they may be used.

According to the above-described embodiment, in a case where the plurality of ink cartridges having the same color are used, the timings when the ink of the ink cartridges is all consumed can match each other without the printing speed and the resolution thereof decreasing, even the ink residual amount are different to each other. Thus, the user can perform the exchange of the ink cartridges at once; the number of exchanges can be decreased so that the effort of the user can be lessened.

Also, the number of the exchanges is decreased so that the number of cleaning and brushing operations that are performed after the exchange of the ink cartridge, which is a change object, is finished can be decreased. Thus, the total amount of the ink that is consumed in the cleaning and the brushing operations of each of the ink cartridges 31 to 35 can be decreased and thus the ink consumption amount can be decreased.

Second Embodiment

The printer 200 of the second embodiment is the same as that of the first embodiment except the operation of the mode selecting process of the CPU 210.

Figure 11:
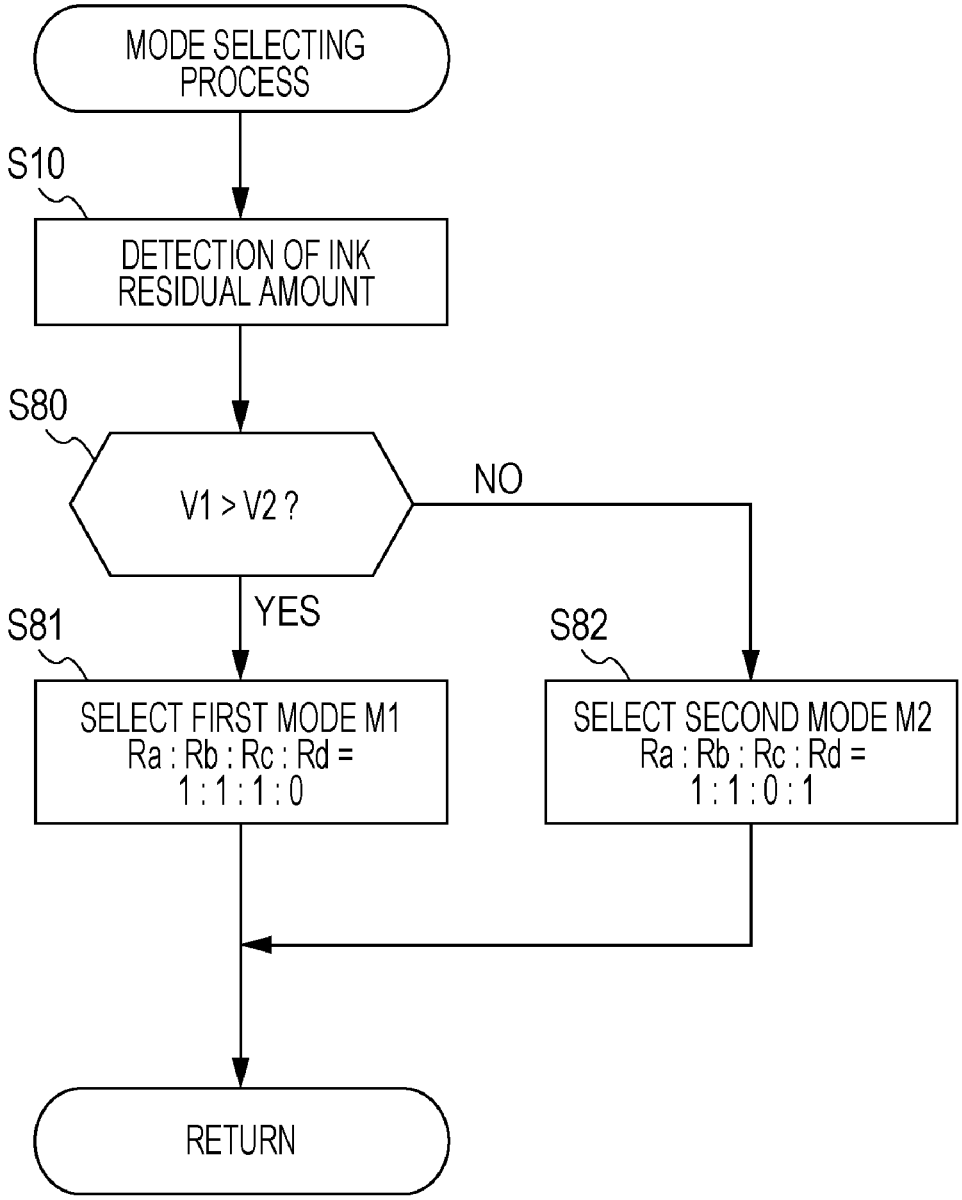
FIG. 11 is a flow chart showing a process content of a mode selecting process regarding a second embodiment of the invention.

FIG. 11 shows a process content of a mode selecting process in a second embodiment of the invention. First of all, the CPU 210 obtains the ink residual amounts V1 and V2 using the ink residual amount detection section 280. Next, the CPU 210 compares the ink residual amount V1 with the ink residual amount V2 and determines whether the ink amount V1 is larger or not (step S80).

In a case where the ink residual amount V1 is larger than the ink residual amount V2, the CPU 210 selects the first mode M1 (step S81), and performs printing using the first and the second ejecting sections 44 and 45; and the first individual ejecting section 46*a* without using the second individual ejecting section 46*b*. Thus, the ink consumption amount of the first ink cartridge 34 is larger than that of the second ink cartridge 35.

In a case where the ink residual amount V2 is larger than the ink residual amount V1, the CPU 210 selects the second mode M2 (step S82), performs printing using the first and the second ejecting sections 44 and 45, and the second individual ejecting section 46*b* without using the first individual ejecting section 46*a*. Thus, the ink consumption amount of the second ink cartridge 35 is larger than that of the first ink cartridge 34.

In the embodiment, the third mode M3 is not present, so that the difference between the ink residual amounts V1 and V2 does not need to be calculated. Accordingly, it has an advantage that the process can be brief.

Modified Embodiments

The invention is not limited to the above-described embodiments, and for example, modified embodiments may be possible as described below.

In the above-described embodiment, the CPU 210 of the ink jet printer 200 controls the frequency of usage of the first and the second ejecting sections 44 and 45; and the first and the second individual ejecting sections 46*a* and 46*b*, however the CPU 110 of the computer 100 performs the printer driver program and thus it may also control them.

In the above-described embodiment, the example is described wherein one ink cartridge for each of cyan, magenta and yellow, and two ink cartridges for black are used, however the number of ink cartridges for each of the colors is not limited to these. For example, a plurality of cartridges may be prepared, regarding cyan, magenta and yellow. Even in this case, the frequency of usage of the ink cartridges is controlled and the ink is averagely ejected, so that the number of exchanges of the ink cartridges is capable of decreasing.

In the above-described embodiments, as the liquid ejecting apparatus, the description has been given regarding the printer 200 that ejects the ink, however the invention is not limited to the above-described embodiments and the invention may be applied to all kinds of liquid ejecting apparatus that eject liquid as liquid droplets. For example, the liquid ejecting apparatus may be a printing apparatus such as facsimile, a copier or the like, a liquid ejecting apparatus that ejects a liquid such as a color material or an electrode material that is used to manufacture a liquid crystal display, EL display and surface light emitting display or the like, a liquid ejecting apparatus that ejects a bioorganic matter that is used to manufacture a bio-chip, and a specimen ejecting apparatus such as a precision pipette. Also, the liquid ejecting apparatus may be applied to a valve apparatus that is used in an apparatus other than a liquid ejecting apparatus.

What is claimed is:

1. A liquid ejecting apparatus that receives liquid from first and second liquid storing materials that store the same liquid and eject the liquid comprising:

first and second ejecting sections in which a plurality of nozzles is formed parallel to a first direction and positions of the nozzles are different to each other in the first direction, an ejecting section group that includes first and second individual ejecting sections in which the positions of the nozzles are different to the first and the second ejecting sections in the first direction and the positions of the nozzles thereof are the same in the first direction, a first flow channel that is branched from the first liquid storing material and communicates with the first ejecting section and the first individual ejecting section, a second flow channel that is branched from the second liquid storing material and communicates with the second ejecting section and the second individual ejecting section, a liquid residual amount detection section that detects first and second residual amounts that are the residual amounts of the liquid that is contained in each of the first and the second liquid storing materials, and a control section that is capable of selecting a first mode that controls so as to be Ra:Rb:Rc:Rd=1:1:1:0, a second mode that controls so as to be Ra:Rb:Rc:Rd=1:1:0:1 and a third mode that controls so as to be Ra:Rb:Rc:Rd=1:1:0.5:0.5, when a frequency of ejecting the liquid using the first and the second ejecting sections and the first and the second individual ejecting sections is Ra, Rb, Rc and Rd, wherein the control section selects any one of the first mode, the second mode and third mode on the basis of the first and the second residual amounts so that exchange timings of the first and the second liquid storing materials are equal to each other.

2. The liquid ejecting apparatus according to claim 1, wherein the control section calculates a difference between the first and the second residual amounts, selects the third mode in a case where the difference is within a predetermined range, selects the first mode in a case where the difference is outside a predetermined range and the first residual amount is larger than the second residual amount, and selects the second mode in a case where the difference is outside a predetermined range and the first residual amount is smaller than the second residual amount.

3. The liquid ejecting apparatus according to claim 1, wherein the control section changes the first individual ejecting section and the second individual ejecting section to each other per unit period and uses them in order in the third mode.

4. The liquid ejecting apparatus according to claim 3, wherein the liquid is ink, the first and the second ejecting sections and the first and the second individual ejecting sections eject the ink on a paper, the unit period is a period that prints a predetermined number of papers, and the control section changes the first individual ejecting section and the second individual ejecting section to each other per the predetermined number and uses them in order in the third mode.

5. The liquid ejecting apparatus according to claim 3, wherein the liquid is ink, the first and the second ejecting sections and the first and the second individual ejecting sections eject the ink on the paper, the unit period is a period that prints a predetermined column number of papers, and the control section changes the first individual ejecting section and the second individual ejecting section to each other per the predetermined column number and uses them in order in the third mode.

6. The liquid ejecting apparatus according to claim 3, wherein the liquid is ink, the first and the second ejecting sections and the first and the second individual ejecting sections eject the ink on the paper, the unit period is a period that prints a predetermined row number of papers, and the control section changes the first individual ejecting section and the second individual ejecting section to each other per the predetermined row number and uses them in order in the third mode.

7. A liquid ejecting apparatus that receives liquid from first and second liquid storing materials that store the same liquid and eject the liquid comprising:

first and second ejecting sections in which a plurality of nozzles is formed parallel to a first direction and positions of the nozzles are different to each other in the first direction, an ejecting section group that includes first and second individual ejecting sections in which the positions of the nozzles are different to the first and the second ejecting sections in the first direction and the position of the nozzles is the same in the first direction, a first flow channel that is branched from the first liquid storing material and communicates with the first ejecting section and the first individual ejecting section, a second flow channel that is branched from the second liquid storing material and communicates with the second ejecting section and the second individual ejecting section, a liquid residual amount detection section that detects first and second residual amounts that are the residual amounts of the liquid that is contained in each of the first and the second liquid storing materials, and a control section that is capable of selecting a first mode that controls so as to be Ra:Rb:Rc:Rd=1:1:1:0, and a second mode that controls so as to be Ra:Rb:Rc:Rd=1:1:0:1, when a frequency of ejecting the liquid using the first and the second ejecting sections and the first and the second individual ejecting sections is Ra, Rb, Rc and Rd, wherein the control section compares the first and the second residual amounts, selects the first mode in a case where the first residual amount is larger than the second residual amount, and selects the second mode in a case where the first residual amount is smaller than the second residual amount.

* * * * *